US008656892B2

(12) United States Patent
Inoue

(10) Patent No.: US 8,656,892 B2
(45) Date of Patent: Feb. 25, 2014

(54) HIGH-PRESSURE PUMP

(75) Inventor: Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 470 days.

(21) Appl. No.: 12/964,917

(22) Filed: Dec. 10, 2010

(65) Prior Publication Data

US 2011/0139126 A1 Jun. 16, 2011

(30) Foreign Application Priority Data

Dec. 10, 2009 (JP) ..... 2009-280844

(51) Int. Cl.
*F02M 37/04* (2006.01)

(52) U.S. Cl.
USPC ..... 123/506

(58) Field of Classification Search
USPC ..... 123/457, 459, 463, 447, 495, 510; 137/115.01, 115.05, 115.06
See application file for complete search history.

(56) References Cited

U.S. PATENT DOCUMENTS

| | | | | |
|---|---|---|---|---|
| 5,152,269 | A * | 10/1992 | Murphy | 123/470 |
| 5,220,941 | A * | 6/1993 | Tuckey | 137/510 |
| 5,265,644 | A * | 11/1993 | Tuckey | 137/510 |
| 6,629,543 | B2 * | 10/2003 | Kilgore | 137/12 |
| 7,267,108 | B2 * | 9/2007 | Barylski et al. | 123/457 |
| 2004/0055582 | A1 | 3/2004 | Yanase et al. | |
| 2011/0114064 | A1 * | 5/2011 | Akita et al. | 123/495 |

FOREIGN PATENT DOCUMENTS

| | | | |
|---|---|---|---|
| JP | 60-119366 | | 6/1985 |
| JP | 2001-090651 | | 4/2001 |
| JP | P2001-227662 | A | 8/2001 |
| JP | P2005-519250 | A | 6/2005 |
| JP | 2006-504903 | | 2/2006 |
| JP | P2006-29423 | A | 2/2006 |
| JP | P2006-322521 | A | 11/2006 |
| JP | P2009-19592 | A | 1/2009 |
| JP | P2009-250172 | A | 10/2009 |
| WO | WO 2009/063306 | | 5/2009 |

OTHER PUBLICATIONS

Japanese Office Action dated Dec. 2, 2011, issued in corresponding Japanese Application No. 2009-280844 with English Translation.

* cited by examiner

*Primary Examiner* — Stephen K Cronin
*Assistant Examiner* — Elizabeth Hadley
(74) *Attorney, Agent, or Firm* — Nixon & Vanderhye P.C.

(57) ABSTRACT

A high-pressure pump for supplying fuel to a fuel rail includes a pressurizing unit, a discharging unit, a return flow channel, a mechanical pressure relief valve, a cup-like shaped spring seat, and a constant residual pressure valve. The return flow channel is closed when pressure of fuel in the fuel rail becomes equal to or less than a predetermined pressure. The spring seat has a guide portion that is formed along an outer shape of a constant residual pressure valve element of the constant residual pressure valve such that the guide portion limits a vortex flow generated at a position downstream of the constant residual pressure valve element in the second flow direction.

9 Claims, 7 Drawing Sheets

HIGH-PRESSURE PUMP

CROSS REFERENCE TO RELATED APPLICATION

This application is based on and incorporates herein by reference Japanese Patent Application No. 2009-280844 filed on Dec. 10, 2009.

BACKGROUND OF THE INVENTION

1. Field of the Invention

The present invention relates to a high-pressure pump for an internal combustion engine (hereinafter referred to as an "engine").

2. Description of Related Art

Conventionally, a fuel supply apparatus for supplying fuel to an engine includes a high-pressure pump that pumps high pressure fuel. A fuel rail connected with injectors stores high pressure fuel pumped by the high-pressure pump. By keeping pressure in the fuel rail, fuel is injected through the injectors.

However, for example, due to the failure of a metering valve of the high-pressure pump, pressure in the fuel rail may sometimes become abnormally high so that the pressure in the fuel rail exceeds an allowable range. As a result, the fuel rail or the injectors may be damaged disadvantageously. In order to deal with the above disadvantage, there has been proposed a high-pressure pump having a pressure relief valve that is opened when the pressure in the fuel rail becomes abnormally high.

Even when the pressure in the fuel rail becomes a predetermined pressure that exceeds the allowable range, the above pressure relief valve is capable of reducing pressure in the fuel rail. When the pressure in the fuel rail stays within the allowable range, the pressure relief valve is not operated. However, even when the pressure in the fuel rail stays within the allowable range, the pressure in the fuel rail may not be within an appropriate range, for example. In the above case, when the engine stops, the injector may cause the fuel leakage into the cylinder, or a fuel injection quantity may be larger than necessary disadvantageously. Also, fuel vapor may occur in the fuel rail disadvantageously.

Therefore, there is further proposed a high-pressure pump that includes the pressure relief valve and also a constant residual pressure valve that is configured to maintain the fuel pressure in the fuel rail in an appropriate condition. In the above high-pressure pump, the constant residual pressure valve is provided within a valve element of the pressure relief valve (see, for example, JP-A-S60-119366). For example, the constant residual pressure valve is a ball valve, and thereby the high-pressure pump is reduced in size.

However, in JP-A-S60-119366, when the constant residual pressure valve is opened, oil tightness between the constant residual pressure valve and the oil valve seat may not be sufficiently achieved. More specifically, when an opening/closing body 32 shown in FIG. 2 of JP-A-S60-119366 opens the valve passage, vortex flow is generated at a position around the opening/closing body 32 or downstream of a spring receiver 34. As a result, the opening/closing body 32 becomes unstable because of the above generated vortex flow. Thus, the opening/closing body 32 tends to be engaged with a valve seat at a position slightly different from a suitable position, at which the opening/closing body 32 closes the valve appropriately. In general, a biasing force for closing the constant residual pressure valve is not sufficiently large. As a result, the slightly different position of the opening/closing body 32 may cause the insufficient oil tightness. Also, in the configuration of JP-A-S60-119366, the machining is difficult, and the manufacturing cost may be increased.

SUMMARY OF THE INVENTION

The present invention is made in view of the above disadvantages. Thus, it is an objective of the present invention to address at least one of the above disadvantages.

To achieve the objective of the present invention, there is provided a high-pressure pump for supplying fuel to a fuel rail connected with an injector, the high-pressure pump including a pressurizing unit, a discharging unit, a return flow channel, a mechanical pressure relief valve, a cup-like shaped spring seat, and a constant residual pressure valve. The pressurizing unit has a pressurizer chamber and a plunger for pressuring fuel, and the pressurizer chamber has a volume that is changeable in accordance with displacement of the plunger. The discharging unit has a discharge valve, through which fuel pressurized in the pressurizer chamber is discharged to the fuel rail. The return flow channel connects a downstream side of the discharge valve with an upstream side of the discharge valve such that the return flow channel allows fuel to return to the upstream side of the discharge valve. The upstream side and the downstream side of the discharge valve are defined relative to a first flow direction of fuel flowing through the discharging unit toward the fuel rail. The mechanical pressure relief valve includes a tubular relief valve element and a relief urging member. The relief valve element is provided in the return flow channel. The relief urging member urges the relief valve element in a direction for closing the return flow channel, and the relief valve element is displaced to open the return flow channel when pressure in the fuel rail becomes equal to or greater than a relief pressure that exceeds an allowable range. The cup-like shaped spring seat is provided within the relief valve element at an upstream side of the relief valve element in a second flow direction of fuel flowing through the return flow channel to the upstream side of the discharge valve. The spring seat has an outer edge urged against an internal upstream part of the relief valve element by the relief urging member. The spring seat defines a flow channel that allows fuel to flow therethrough. The constant residual pressure valve is provided within the spring seat. The constant residual pressure valve includes a constant residual pressure valve element and a constant residual pressure urging member. The constant residual pressure valve element is engageable with a valve seat formed within the relief valve element to prohibit fuel from flowing through a restrictor of the relief valve element. The restrictor is provided at a position on an upstream side of the relief valve element. The constant residual pressure urging member urges the constant residual pressure valve element in a direction for closing the return flow channel. The return flow channel is opened and closed in accordance with pressure of fuel flowing through the restrictor. The return flow channel is closed when pressure of fuel in the fuel rail becomes equal to or less than a predetermined pressure. The spring seat has a guide portion that is formed along an outer shape of the constant residual pressure valve element such that the guide portion limits a vortex flow generated at a position downstream of the constant residual pressure valve element in the second flow direction.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

Embodiments of the present invention will be described with accompanying drawings.

Figure 1:
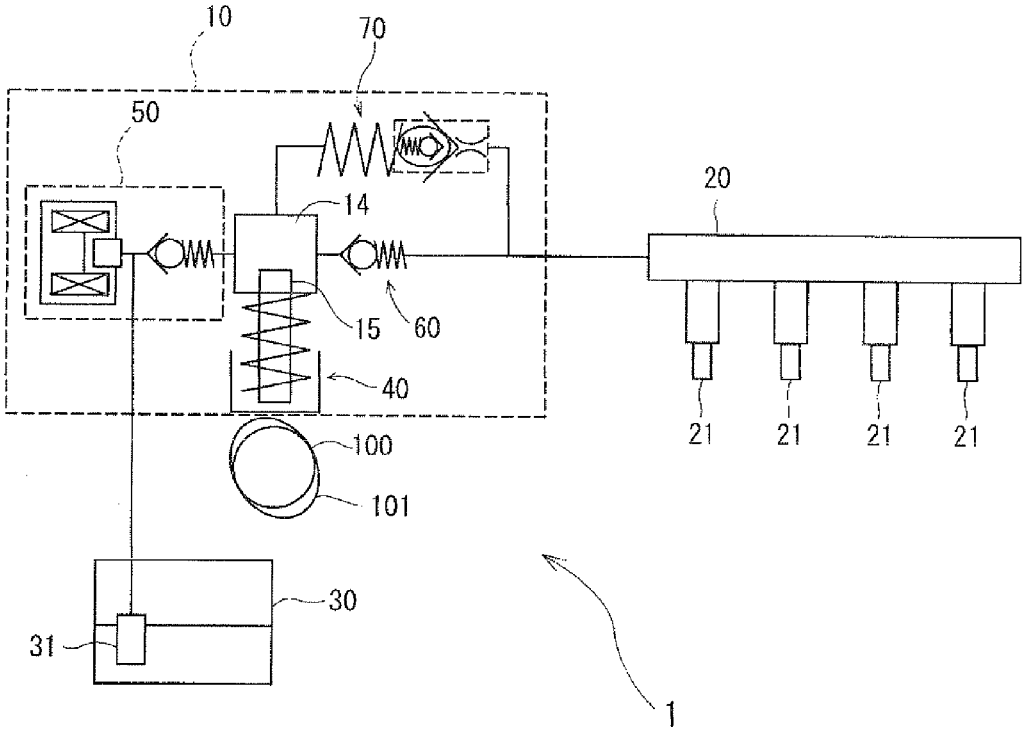
FIG. 1 is an explanatory diagram illustrating a fuel supply apparatus according to one embodiment of the present invention.

FIG. 1 shows a fuel supply apparatus according to one embodiment of the present invention.

As shown in FIG. 1, a fuel supply apparatus 1 includes a high-pressure pump 10 and a fuel rail 20.

The high-pressure pump 10 pressurizes fuel supplied by a low-pressure pump 31 from a fuel tank 30 and discharges high pressure fuel. The fuel rail 20 stores the discharged fuel. The fuel rail 20 has multiple injectors 21 connected thereto. For example, in the present embodiment, four injectors 21 are connected to the fuel rail 20. High pressure fuel stored in the fuel rail 20 is injected through the injectors 21 when the injectors 21 are energized by an ECU (not shown). In the above, the ECU outputs pulse signals for driving the injectors 21. Thus, a width of the pulse signal (injector drive pulse width) and pressure in the fuel rail 20 controls injection quantities.

The high-pressure pump 10 includes a plunger unit 40, a metering valve unit 50, a discharge valve unit 60, and a pressure adjustment unit 70. The plunger unit 40 reciprocates a plunger 15 along a profile of a cam 101 based on rotation of a camshaft 100. The metering valve unit 50 includes a solenoid valve and controls an amount of displacement of a plunger to adjust the amount of fuel in a pre-stroke control.

Next, a configuration of the discharge valve unit 60 and the pressure adjustment unit 70 will be described with reference to FIG. 2.

The high-pressure pump 10 has a housing 11 and a cover 12. The housing 11 forms an outer rim, and the cover 12 is provided on an upper surface side of the high-pressure pump 10. Thus, a fuel gallery (not shown) is formed.

The housing 11 defines a pressurizer chamber 14 formed at a generally center section. The pressurizer chamber 14 is a space defined by the housing 11 and an upper surface of the plunger 15. Thus, a volume of the pressurizer chamber 14 is changeable in accordance with displacement of the plunger 15, and thereby the pressurizer chamber 14 is capable of pressurizing fuel.

Figure 2:
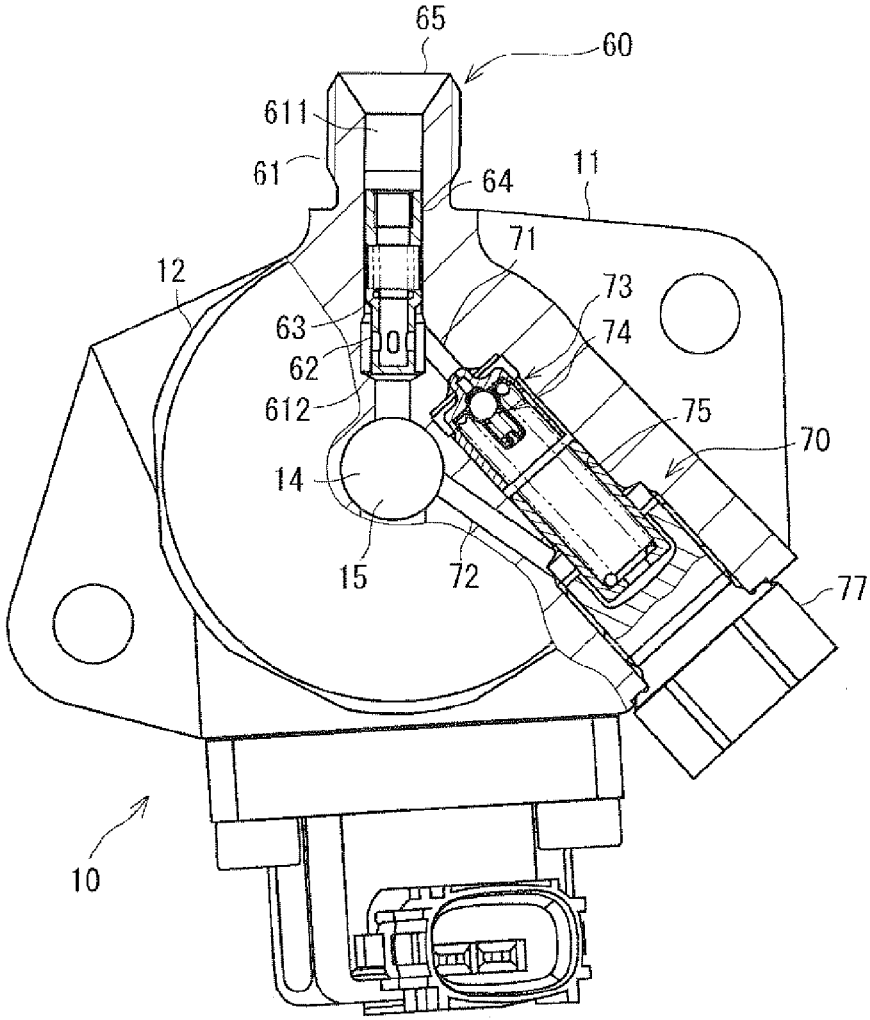
FIG. 2 is a plan view illustrating a cross section of a part of the high-pressure pump.

The pressurizer chamber 14 is connected with the discharge valve unit 60 (see upper part of FIG. 2). The discharge valve unit 60 has a hollow cylindrical receiving portion 61 formed by the housing 11 as shown in FIG. 2. The receiving portion 61 defines a receiving chamber 611 that receives therein a discharge valve element 62, a spring 63, and an engagement part 64. Also, an opening of the receiving chamber 611 serves as a discharge port 65. A valve seat 612 is formed at a back of the receiving chamber 611 remote from the discharge port 65.

the discharge valve element 62 contacts the valve seat 612 by a biasing force of the spring 63 and pressure in the fuel rail. Therefore, the discharge valve element 62 stops discharging fuel when pressure of fuel in the pressurizer chamber 14 is substantially low. In contrast, when pressure of fuel in the pressurizer chamber 14 becomes greater than a resultant force of the biasing force of the spring 63 and the pressure in the fuel rail, the discharge valve element 62 is displaced in a direction toward the discharge port 65. As a result, fuel flowing into the receiving chamber 611 is discharged through the discharge port 65. It should be noted that the discharge valve element 62 defines an internal space that serves as a fuel passage. Thereby, when the discharge valve element 62 is disengaged from the valve seat 612, fuel flowing around an outer peripheral part of the discharge valve element 62 flows into the internal space of the discharge valve element 62. Then, fuel within the internal space of the discharge valve element 62 is discharged through the discharge port 65.

In FIG. 2, the pressure adjustment unit 70 is provided on a right side of the pressurizer chamber 14.

A return flow channel 71 is connected to the receiving chamber 611 at a position downstream of the valve seat 612 in a flow direction of fuel that is discharged through the discharge port 65. Also, a return flow channel 72 is connected to the pressurizer chamber 14. Both of the return flow channels 71, 72 form a passage, through which a part of fuel in the receiving chamber 611 of the discharging valve unit 60 returns to the pressurizer chamber 14. The pressure adjustment unit 70 is provided between the return flow channels 71, 72.

Figure 3:
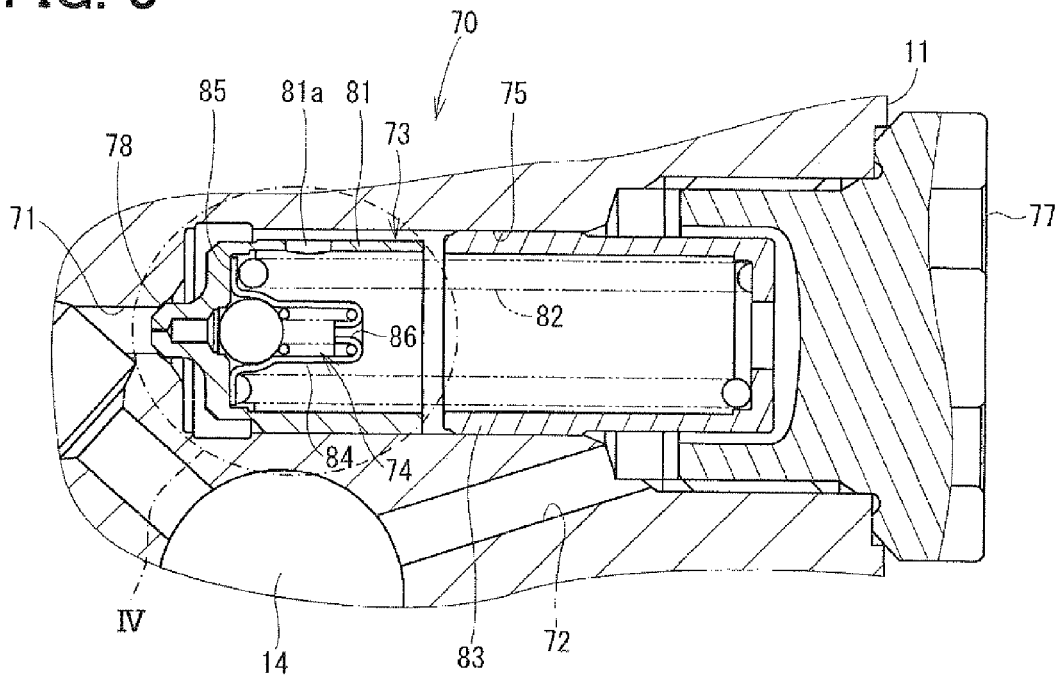
FIG. 3 is a schematic cross-sectional view of a pressure adjustment unit of the one embodiment.
Figure 4:
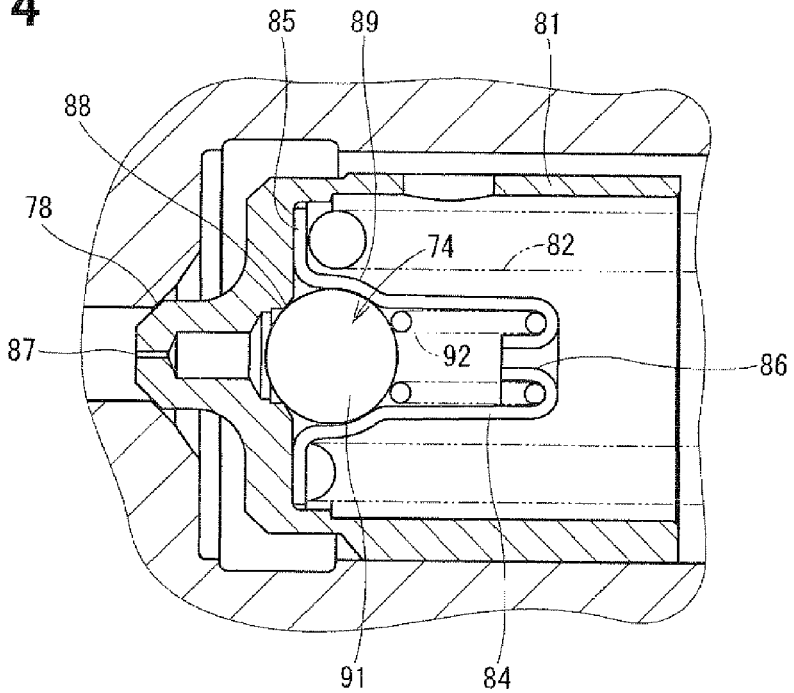
FIG. 4 is a partially enlarged sectional view of FIG. 3.

The pressure adjustment unit 70 includes a mechanical pressure relief valve 73 and a mechanical constant residual pressure valve 74. Next, a configuration of the pressure relief valve 73 and the constant residual pressure valve 74 will be described. FIG. 3 is an explanatory diagram illustrating the pressure adjustment unit 70. Also, FIG. 4 is a partially enlarged sectional view of FIG. 3.

In the present embodiment, as above, the pressure adjustment unit 70 includes the return flow channels 71, 72, the mechanical pressure relief valve 73, and the mechanical constant residual pressure valve 74. The pressure adjustment unit 70 of the present embodiment does not include electromagnetic valves in the present embodiment.

The return flow channels 71, 72 constitute a flow channel, through which fuel returns to an upstream side of the discharge valve from a downstream side of the discharge valve. In the above, the downstream side and the upstream side of the discharge valve are defined relative to a first flow direction of fuel flowing through the receiving chamber 611 of the discharge valve unit 60 toward the fuel rail 20, for example. Also, the above discharge valve may include the discharge valve element 62 and the valve seat 612. Thus, the downstream side of the discharge valve corresponds to the downstream side of the valve seat 612, and the upstream side of the discharge valve corresponds to the upstream side of the valve seat 612. Also, fuel may return to a passage, which has high-pressure fuel therein, located upstream of the discharge valve. Alternatively, fuel may return to the other passage, which has low-pressure fuel therein, located further upstream of the discharge valve. Also, fuel flows through the return flow channels 71, 72 in a second flow direction in order to return to the upstream side of the discharge valve.

As shown in FIG. 3, the pressure relief valve 73 is provided in a fuel passage 75 that is connected to the return flow channel 71. The fuel passage 75 has a diameter greater than a diameter of the return flow channel 71. The return flow channel 72 provides communication between the fuel passage 75 and the pressurizer chamber 14. The pressure relief valve 73 and the constant residual pressure valve 74 are assemble to the fuel passage 75 through an opening of the housing 11. As shown in FIG. 3, the opening is threadably engaged with an engagement part 77 having a hexagon head bolt, and thereby the opening is closed.

The pressure relief valve 73 has a tubular relief valve element 81 and a spring 82 that urges the relief valve element 81.

The relief valve element 81 is supported by the fuel passage 75 displaceably in a longitudinal direction of the fuel passage 75.

The spring 82 has one end engaged with a tubular engagement part 83 that is provided downstream of the relief valve element 81 in a direction, in which fuel returns to the pressurizer chamber 14 through the fuel passage 75. Also, the spring 82 has the other end engaged with the relief valve element 81. More specifically, a spring seat 84 is provided within the relief valve element 81 at an upstream side of the relief valve element 81, and the spring 82 urges an outer edge 85 of the spring seat 84 against an internal upstream part of the relief valve element 81 in the direction away from the engagement part 83. Furthermore, a connection part between the return flow channel 71 and the fuel passage 75 is provided with a valve seat 78, and the spring 82 urges the relief valve element 81 such that a peripheral edge of the end portion of the relief valve element 81 is brought into contact with the valve seat 78.

The relief valve element 81 is normally engaged with the valve seat 78. When fuel pressure in the fuel rail 20 shown in FIG. 1 exceeds a relief pressure that is equal to or greater than an allowable range, fuel pressure, which is applied to the end portion of the relief valve element 81, causes the relief valve element 81 to be disengaged from the valve seat 78 against the biasing force of the spring 82. In other words, the biasing force of the spring 82 is adjusted such that the pressure relief valve 73 is opened when fuel pressure in the fuel rail 20 becomes equal to or greater than the relief pressure.

It should be noted that the relief valve element 81 has an opening 81*a* at a peripheral wall thereof. As a result, when the end portion of the relief valve element 81 is disengaged from the valve seat 78, fuel that has entered into the fuel passage 75 flows into the internal space within the relief valve element 81 through the opening 81*a*. Then, fuel flows in a direction from the internal space to the downstream side of the relief valve element 81.

The spring seat 84 has a cup-like shape as described above, and the cup is placed such that the opening of the cup faces toward the upstream end of the fuel passage 75. In other words, the bottom of the cup shape of the spring seat 84 is positioned remote from the upstream end of the fuel passage 75. Also, the spring seat 84 receives the constant residual pressure valve 74 therein.

The constant residual pressure valve 74 has a constant residual pressure valve element 91 and a spring 92 as shown in FIG. 4.

The constant residual pressure valve element 91 has a ball shape. The end portion of the relief valve element 81 is formed with an orifice 87 that has a relatively small flow channel area. Also, the relief valve element 81 has a valve seat 88 formed at a position downstream of the orifice 87, and the valve seat 88 is engageable with the constant residual pressure valve element 91.

The spring 92 has one end that is engaged with the constant residual pressure valve element 91 and has the other end that is engaged with the spring seat 84. More specifically, the downstream end of the spring seat 84 is bent in a radially inward direction such that the downstream end is engaged with the spring 92. At the same time, the bent downstream end forms a through bore 86. Thus, the through bore 86 is positioned at a downstream end of the spring seat 84 in the second flow direction of fuel.

Due to the above configuration, the constant residual pressure valve element 91 is normally disengaged from the valve seat 88 in a normal operation. When fuel pressure in the fuel rail 20 shown in FIG. 1 becomes equal to or less than a predetermined pressure, the biasing force of the spring 92 and fuel pressure applied to the valve element 91 from downstream side thereof bring the constant residual pressure valve element 91 into engagement with the valve seat 88. In other words, the biasing force of the spring 92 is adjusted such that the constant residual pressure valve 74 is closed when the fuel pressure in the fuel rail 20 becomes equal to or less than the predetermined pressure. It should be noted that in the present embodiment, the predetermined pressure is set equal to or less than a pressure in the fuel rail 20 when the engine is operated under a stand-by operation and simultaneously when fuel becomes equal to or greater than a saturated vapor pressure.

The constant residual pressure valve 74 is normally opened as described above. However, the constant residual pressure valve 74 is exceptionally closed during the pressurizing stroke of the plunger unit 40 of the high-pressure pump 10 because the fuel pressure on the downstream side of the constant residual pressure valve element 91 of the constant residual pressure valve 74 is increased.

In the present embodiment, the spring seat 84 has a guide portion 89 formed along the outer shape of the constant residual pressure valve element 91. The guide portion 89 limits the generation of a vortex flow generated a position downstream of the constant residual pressure valve element 91. Usually, the vortex flow is generated by fuel when the fuel flows into the spring seat 84 upon the disengagement of the constant residual pressure valve element 91 from the valve seat 88.

As above, in the high-pressure pump 10 of the present embodiment, the pressure relief valve 73 and the constant residual pressure valve 74 are capable of adjusting pressure in the fuel rail. Furthermore, because the spring seat 84 is used for forming the constant residual pressure valve 74 within the pressure relief valve 73, the machining is facilitated, and thereby the manufacturing cost is effectively reduced. Furthermore, the guide portion 89 of the spring seat 84 effectively limits the vortex flow generated at the position downstream of the constant residual pressure valve element 91. As a result, the constant residual pressure valve element 91 is stably positioned when the constant residual pressure valve 74 is opened. Thus, even if the fuel pressure for closing the constant residual pressure valve 74 is small, the constant residual pressure valve element 91 is engageable with the valve seat 88 at a position similar to the position before the constant residual pressure valve 74 is opened. As a result, it is possible to prevent the reduction of the oil tightness of the constant residual pressure valve 74. Also, because the return flow channels 71, 72 provide communication between the downstream side of the discharge valve 62 and the pressurizer chamber 14, it is possible to close the constant residual pressure valve 74 based on the balance between (a) fuel pressure in the pressurizer chamber 14 and (b) pressure in the fuel rail 20. During a time period, in which pressure in the pressurizer chamber 14 is increased, such as during a pressurizing stroke by the plunger 15 of the high-pressure pump 10, the constant residual pressure valve 74 is maintained closed. Due to the above configuration, it is possible to limit the leakage of fuel through the return flow channels 71, 72, and thereby it is possible to effectively limit the degradation of a pump efficiency.

The guide portion 89 is capable of effectively limiting flow of fuel, which flows into the pressure relief valve element 81 through the opening 81*a* (transverse hole), from influencing the operation of the constant residual pressure valve element 91 and the spring 92 during the operation of the pressure relief valve 73. As a result, after the operation of the pressure relief valve 73, it is possible to bring the pressure relief valve element 81 back to a position similar to the original position of the pressure relief valve element 81 positioned in advance of the opening of the pressure relief valve 73. As a result, it is possible to limit the degradation of the oil tightness of the constant residual pressure valve 74.

It should be noted that in the present embodiment, the high-pressure pump 10 corresponds to "high-pressure pump". The fuel rail 20 corresponds to a "fuel rail". The plunger unit 40 corresponds to a "pressurizing unit". The pressurizer chamber 14 corresponds to a "pressurizer chamber". The discharge valve unit 60 corresponds to a "discharging unit". Also, the return flow channels 71, 72 correspond to a "return flow channel". The pressure relief valve 73 corresponds to a "pressure relief valve", and the relief valve element 81 corresponds to a "relief valve element". The spring 82 corresponds to "relief urging member", and the constant residual pressure valve 74 corresponds to a "constant residual pressure valve". The constant residual pressure valve element 91 corresponds to a "constant residual pressure valve element", and the spring 92 corresponds to a "constant residual pressure urging member". The orifice 87 corresponds to an "upstream restrictor". Also, the spring seat 84 corresponds to a "spring seat", and the guide portion 89 corresponds to a "guide portion". The through bore 86 corresponds to a "through bore".

As above, the present invention is not limited to the above embodiments. However, the present invention may be alternatively modified provided that the modification does not deviate from the gist and the scope of the invention.

Figure 5:
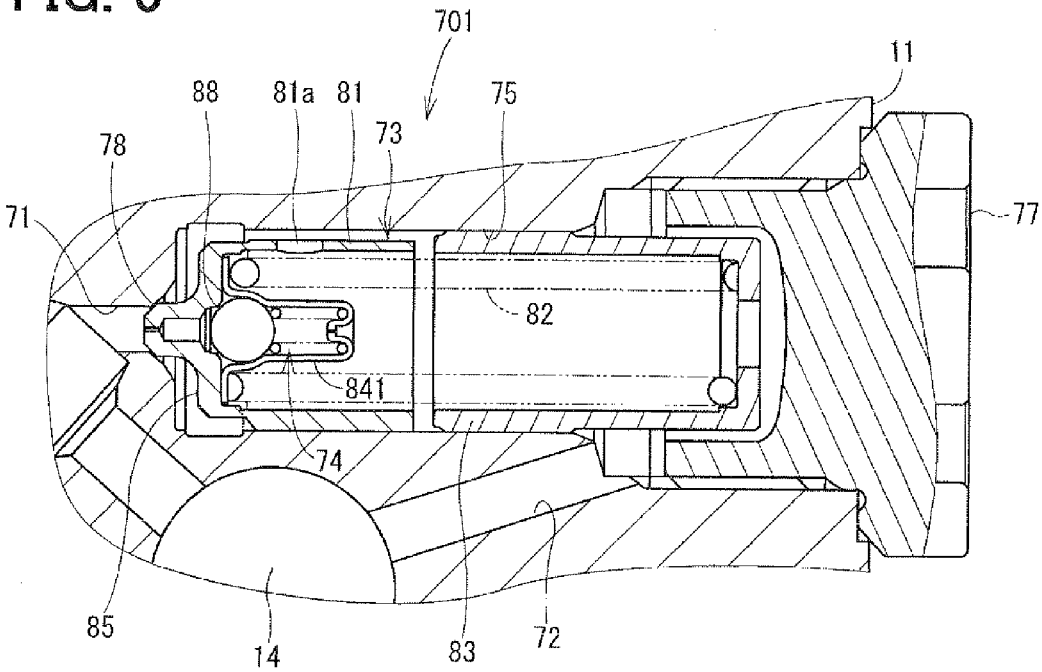
FIG. 5 is a schematic cross-sectional view of a pressure adjustment unit according to a modified embodiment of the present invention.
Figure 6:
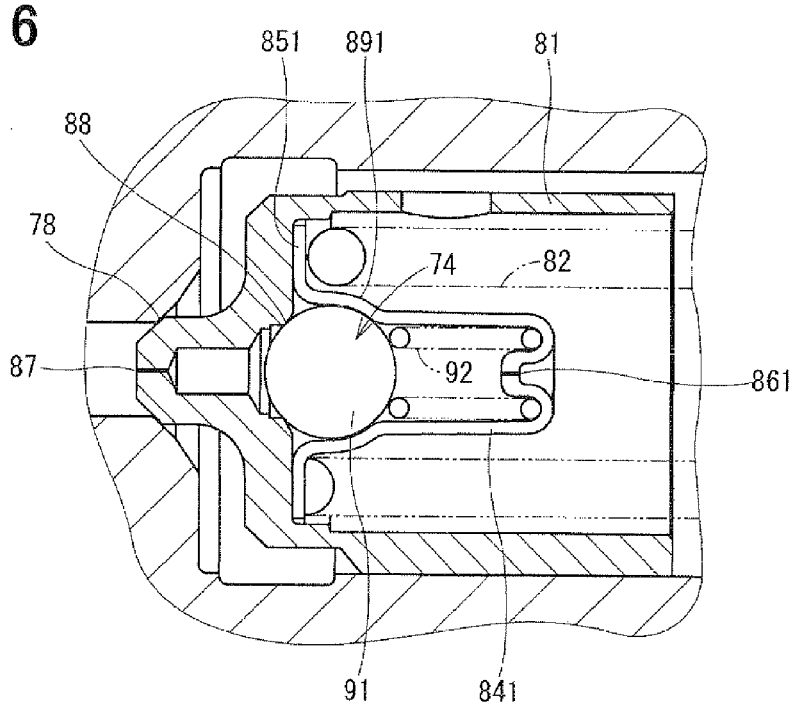
FIG. 6 is a partially enlarged sectional view of FIG. 5.

(1) For example, the pressure adjustment unit 701 shown in FIGS. 5 and 6 may be alternatively provided. FIG. 5 is a schematic cross-sectional view illustrating the pressure adjustment unit 701, and FIG. 6 is a partially enlarged sectional view of FIG. 5. It should be noted that the similar components of the modified embodiment, which are similar to those in the above embodiment, will be indicated by the same numeral.

In the present embodiment, as shown in FIG. 6, there is provided a spring seat 841 having a cup-like shape. The spring seat 841 has an outer edge 851 that is engaged with one end of the spring 82. Also, the constant residual pressure valve 74 is formed within the spring seat 841. The constant residual pressure valve 74 has the configuration as described in the above embodiment. Also, the spring seat 841 has a guide portion 891 that is formed along the outer shape of the constant residual pressure valve element 91.

In the present embodiment, as shown in FIG. 6, a downstream end of the spring seat 841 is bent in a radially inward direction to be engaged with the spring 92. Also, the downstream end of the spring seat 841 forms a through bore 861 having a relatively small flow channel area.

Due to the above configuration, the advantages similar to those in the above embodiment will be achievable in the present embodiment. Furthermore, because the orifice 87 and the through bore 861, both of which has the relatively small flow channel areas, are arranged in series with each other, the restriction function is effectively achievable. Due to the above configuration, compared with a case, where only the orifice 87 is provided on the upstream end of the relief valve element 81, it is possible to enlarge the flow channel areas of the orifice 87 and the through bore 861. As a result, it is possible to avoid the possible deficiency caused by the clogging of foreign objects and heavy crude fuel.

It should be noted that the spring seat 841 of the present embodiment corresponds to a "spring seat", the guide portion 891 corresponds to a "guide portion", and the through bore 861 corresponds to a "downstream restrictor".

Figure 7:
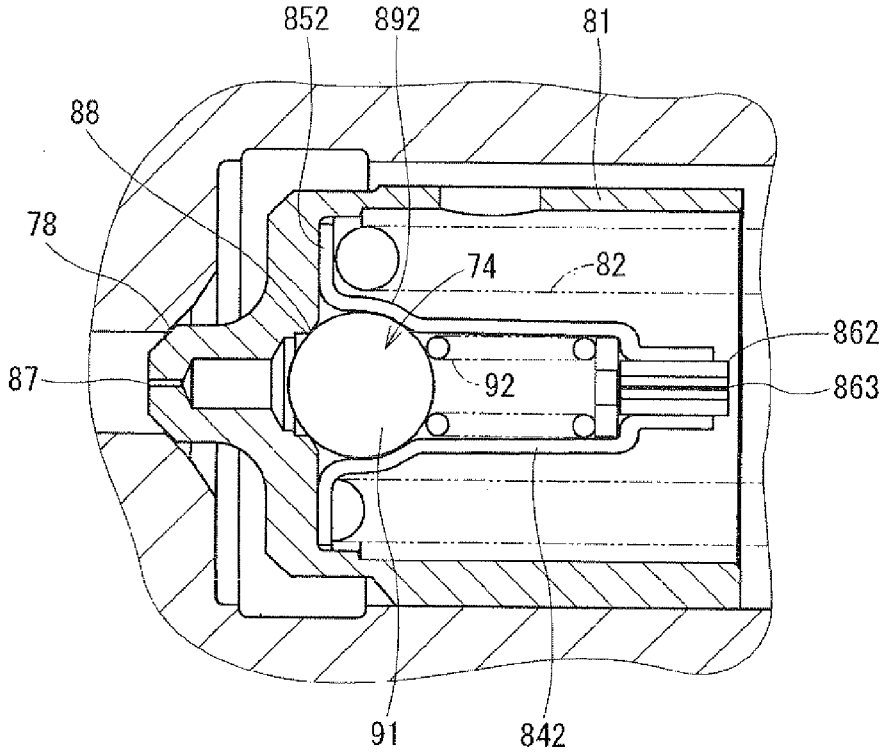
FIG. 7 is a partially enlarged sectional view of a pressure adjustment unit according to another modified embodiment of the present invention.

(2) In the item (1), the through bore 861 having the relatively small flow channel area is formed by bending the downstream end of the spring seat 841. Alternatively, a spring seat 842 as shown in FIG. 7 may be employed. FIG. 7 is a partially enlarged sectional view illustrating a spring seat of another modified embodiment. It should be noted that the similar components of the present modified embodiment, which are similar to those in the above embodiment, will be indicated by the same numeral.

In the present embodiment, the spring seat 842 has a cup-like shape. In the above, the spring seat 842 has an outer edge 852 that is engaged with one end of the spring 82. Also, the constant residual pressure valve 74 is formed within the spring seat 842. The constant residual pressure valve 74 has the configuration similar to the configuration of the above embodiments. Also, the spring seat 842 has a guide portion 892 formed along the outer shape of the constant residual pressure valve element 91.

In the present embodiment, as shown in FIG. 7, a spring pin 862 is received in a fixed manner within the spring seat 842 at a position downstream of the spring seat 842. The spring pin 862 generates a pressing force in a radially outward direction, and has a cross section of a C shape. A slit and an inner periphery of the spring pin 862 forms the through bore 863 that has a relatively small flow channel area.

In the present embodiment, the spring seat 842 further has the spring pin 862 that is received within the through bore 863, as above. Then, the spring pin 862 and the through bore 863 constitute a downstream restrictor. As a result of employing the spring pin 862 as above, it is possible to easily form the downstream restrictor that is positioned downstream of the orifice 87 that serves as an upstream restrictor.

Due to the above configuration, advantages similar to those in the above embodiment are achievable in the present embodiment. Furthermore, because the orifice 87 and the through bore 863, both of which have the small flow channel areas, are arranged in series with each other, the restriction function is effectively achievable. Due to the above configuration, compared with a case, where only one restrictor, such as the orifice 87, is provided on the upstream side of the relief valve element 81, it is possible to enlarge the flow channel areas of the orifice 87 and the through bore 863. As a result, it is possible to avoid the deficiency caused by the clogging of the foreign objects heavy crude fuel.

It should be noted that in the present embodiment, the spring seat 842 corresponds to a "spring seat", the guide portion 892 corresponds to a "guide portion", the spring pin 862 corresponds to a "spring pin", and the through bore 863 corresponds to a "downstream restrictor".

Figure 8A:
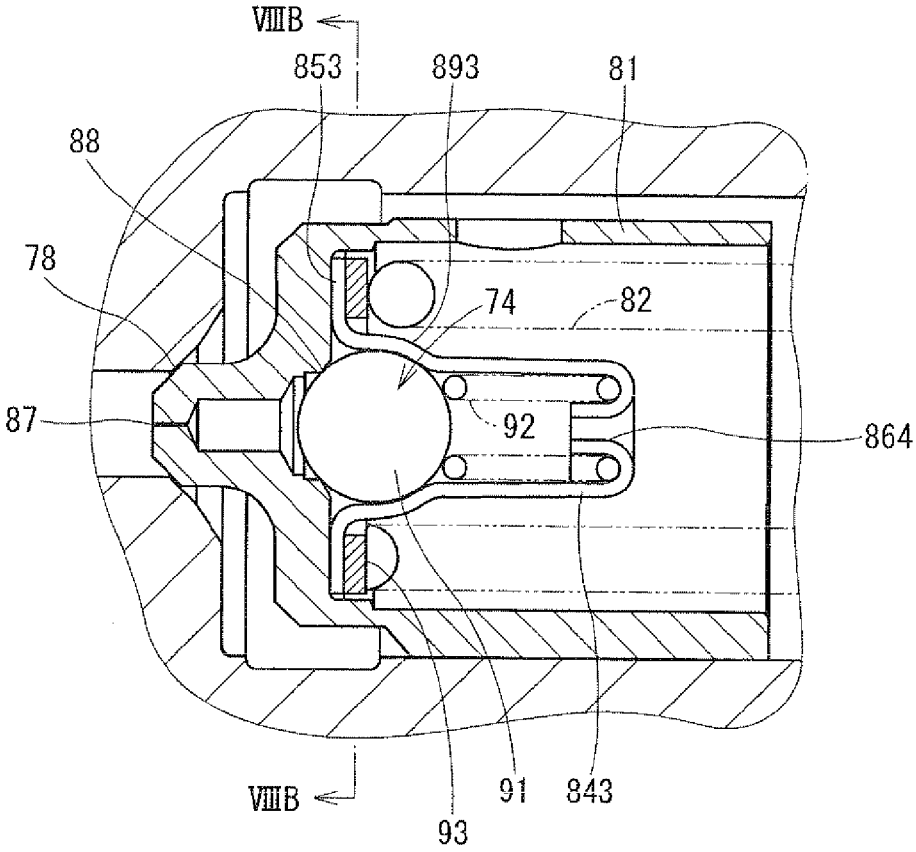
FIG. 8A is a partially enlarged sectional view of a pressure adjustment unit according to still another modified embodiment of the present invention.
Figure 8B:
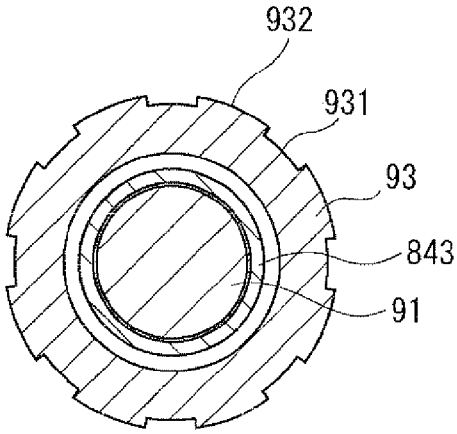
FIG. 8B is a cross-sectional view of the pressure adjustment unit taken along line VIIIB-VIIIB in FIG. 8A.

(3) Also, a spring seat 843 shown in FIGS. 8A and 8B may be employed in order to reduce the time required for assembly in another modified embodiment. FIG. 8A is a partially enlarged sectional view illustrating the spring seat 843. Also, FIG. 8B is a cross-sectional view taken along line VIIIB-VIIIB in FIG. 8A. It should be noted that the similar components of the present modified embodiment, which are similar to those in the above embodiment, will be indicated by the same numeral.

In the present embodiment, the spring seat 843 has the cup-like shape. The spring seat 843 has an outer edge 853 that is engaged with the one end of the spring 82 in a state, where a ring member 93 is provided between the spring 82 and the outer edge 853. The constant residual pressure valve 74 is provided within the spring seat 843. The constant residual pressure valve 74 has the configuration similar to the configuration of the above embodiments. Also, the spring seat 843 has a guide portion 893 formed along the outer shape of the constant residual pressure valve element 91.

In the present embodiment, as shown in FIGS. 8A and 8B, the ring member 93 has multiple slits 931 formed at a peripheral edge of the ring member 93. More specifically, there are eight slits 931 in the present embodiment. Projection parts 932 are formed between the slits 931 to radially outwardly project from the ring member 93. The projection parts 932 of the ring member 93 are assembled to be engaged in the inner peripheral wall of the relief valve element 81 such that the ring member 93 is fixed to the relief valve element 81.

Due to the above configuration, advantages similar to those in the above embodiment are achievable in the present embodiment. Furthermore, because the ring member 93 is provided as above, it is possible to assemble the spring seat 843 to the relief valve element 81 without providing the spring 82. As a result, it is possible to prepare the constant residual pressure valve 74 as a sub-assembly. As a result, the time required for the assembly process is effectively reduced.

Also, when the spring 82 urges the spring seat 843 through the ring member 93, it is possible to stably bring the outer edge 853 of the spring seat 843 into contact with the relief valve element 81.

The spring seat 843 is separated from the ring member 93 as above. However, the slits 931 and the projection parts 932, which are similar to those of the ring member 93, may be alternatively provided to the outer edge 853 of the spring seat 843.

In the present embodiment, the spring seat 843 corresponds to a "spring seat", the guide portion 893 corresponds to a "guide portion", the through bore 864 corresponds to a "through bore", and the ring member 93 corresponds to a "ring engagement part".

Figure 9A:
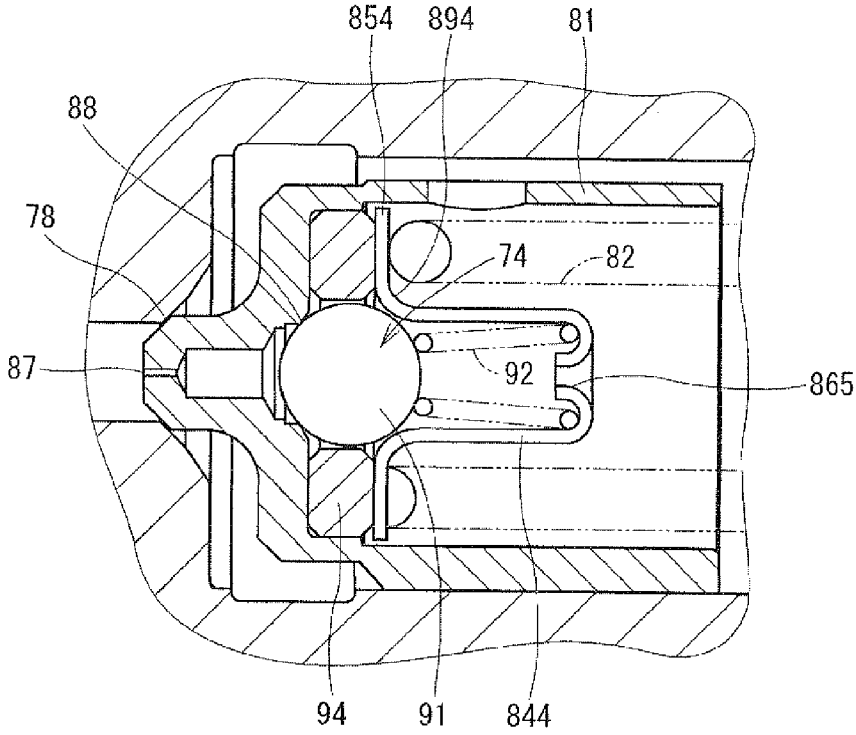
FIG. 9A is a partially enlarged sectional view of a pressure adjustment unit according to further another modified embodiment of the present invention.
Figure 9B:
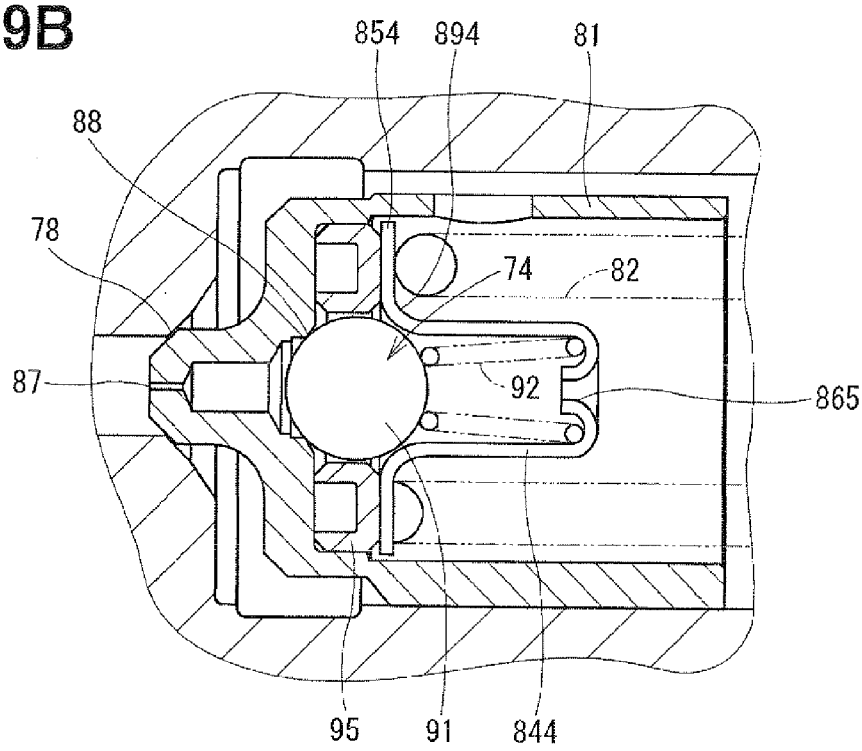
FIG. 9B is a partially enlarged sectional view of a pressure adjustment unit according to still another modified embodiment of the present invention.

(4) Also, a spring seat 844 shown in FIGS. 9A and 9B may be alternatively employed in another modified embodiment. FIG. 9A is a partially enlarged sectional view illustrating the spring seat 844. It should be noted that the similar components of the present modified embodiment, which are similar to those in the above embodiment, will be indicated by the same numeral.

In the present embodiment, the spring seat 844 has a cup-like shape. A washer member 94 is provided on an upstream side of an outer edge 854 of the spring seat 844 opposite from the spring 82. In other words, the washer member 94 is provided between the relief valve element 81 and the outer edge 854 of the spring seat 844. The constant residual pressure valve 74 is formed within the spring seat 844. The constant residual pressure valve 74 has the configuration similar to the configuration of the above embodiments. Also, the spring seat 844 has the guide portion 894 formed along the outer shape of the constant residual pressure valve element 91. Also, the washer member 94 is provided to cover an outer periphery of the constant residual pressure valve element 91.

The washer member 94 has an inner diameter that is formed slightly greater than an outer diameter of the constant residual pressure valve element 91. As a result, a restrictor is formed between the washer member 94 and the constant residual pressure valve element 91. Due to the above configuration, the above restrictor is formed in series with the other restrictor, which is the orifice 87. As a result, the total flow channel area of the restrictors is further increased. Alternatively, the washer member 94 may be also applicable to the spring seats 841, 842 of the other modified embodiment. In the above alternative case, it is possible to enlarge the flow channel areas of the orifice 87 and the through bores 861, 863.

The above washer member may be alternatively produced through a certain process, such as a press process. FIG. 9B shows a washer 95 that is produced through the certain process. Because the washer 95 has a cross section of a U shape having a hollow therein, the washer 95 is lighter in weight than the solid washer member 94 shown in FIG. 9A. As a result, the responsivity of the pressure relief valve 73 of FIG. 9B in the operation is effectively improved.

In the present embodiment, the spring seat 844 corresponds to a "spring seat", the guide portion 894 corresponds to a "guide portion", the through bore 865 corresponds to a "through bore", and the washer member 94, 95 corresponds to a "washer member".

Additional advantages and modifications will readily occur to those skilled in the art. The invention in its broader terms is therefore not limited to the specific details, representative apparatus, and illustrative examples shown and described.

What is claimed is:

1. A high-pressure pump for supplying fuel to a fuel rail connected with an injector, the high-pressure pump comprising:

a pressurizing unit having a pressurizer chamber and a plunger for pressuring fuel, the pressurizer chamber having a volume that is changeable in accordance with displacement of the plunger;

a discharging unit having a discharge valve, through which fuel pressurized in the pressurizer chamber is discharged to the fuel rail;

a return flow channel that connects a downstream side of the discharge valve with an upstream side of the discharge valve such that the return flow channel allows fuel to return to the upstream side of the discharge valve, the upstream side and the downstream side of the discharge valve being defined relative to a first flow direction of fuel flowing through the discharging unit toward the fuel rail;

a mechanical pressure relief valve that includes:

a tubular relief valve element provided in the return flow channel; and a relief urging member that is configured to urge the relief valve element in a direction for closing the return flow channel, wherein the relief valve element is displaced to open the return flow channel when pressure in the fuel rail becomes equal to or greater than a relief pressure that exceeds an allowable range;

a cup-like shaped spring seat that is provided within the relief valve element at an upstream side of the relief valve element in a second flow direction of fuel flowing through the return flow channel to the upstream side of the discharge valve, the spring seat having an outer edge urged against an internal upstream part of the relief valve element by the relief urging member, the spring seat defining a flow channel that allows fuel to flow therethrough; and a constant residual pressure valve that is provided within the spring seat, wherein:

the constant residual pressure valve includes:

a constant residual pressure valve element that is engageable with a valve seat formed within the relief valve element to prohibit fuel from flowing through a restrictor of the relief valve element, the restrictor being provided at a position on an upstream side of the relief valve element; and a constant residual pressure urging member that is configured to urge the constant residual pressure valve element in a direction for closing the return flow channel;

the return flow channel is opened and closed in accordance with pressure of fuel flowing through the restrictor;

the return flow channel is closed when pressure of fuel in the fuel rail becomes equal to or less than a predetermined pressure;

the spring seat has a guide portion that is formed along an outer shape of the constant residual pressure valve element such that the guide portion limits a vortex flow generated at a position downstream of the constant residual pressure valve element in the second flow direction;

the constant residual pressure urging member of the constant residual pressure valve is arranged inside of the a relief urging member of the pressure relief valve; and the spring seat includes a bent portion.

2. The high-pressure pump according to claim 1, wherein:

the spring seat has a through bore that allows fuel to flow therethrough; and the through bore is positioned at a position downstream of the spring seat in the second flow direction.

3. The high-pressure pump according to claim 2, wherein:

the restrictor serves as an upstream restrictor; and the through bore serves as a downstream restrictor that is provided in series at a position downstream of the upstream restrictor.

4. The high-pressure pump according to claim 3, wherein:

the spring seat further has a spring pin that is received within the through bore;

the spring pin generates a pressing force that is applied to the through bore in a radially outward direction;

the spring pin has a cross section of a C shape; and the spring pin and the through bore constitute the downstream restrictor.

5. The high-pressure pump according to claim 1, wherein:

the spring seat has an engagement part having a ring shape;

the engagement part is provided at an outer edge of the spring seat for engagement with one end of the relief urging member; and the engagement part is engaged in an inner peripheral wall of the relief valve element.

6. The high-pressure pump according to claim 5, wherein:

the engagement part is separated from the spring seat.

7. The high-pressure pump according to claim 1, further comprising:

a washer member that is provided between the relief valve element and an outer edge of the spring seat such that the washer member covers an outer periphery of the constant residual pressure valve element.

8. The high-pressure pump according to claim 7, wherein:

the washer member has an inner diameter slightly greater than an outer diameter of the constant residual pressure valve element.

9. The high-pressure pump according to claim 1, wherein:

the return flow channel provides communication between the downstream side of the discharge valve and the pressurizer chamber.

* * * * *